US006238198B1

(12) United States Patent
Hatasa et al.

(10) Patent No.: US 6,238,198 B1
(45) Date of Patent: May 29, 2001

(54) ROLL-OUT APPARATUS FOR CORRUGATING ROLLER

(75) Inventors: Kazuhiro Hatasa, Ena-gun; Yuuji Yamazaki, Kasugai; Katsuya Sugino, Komaki, all of (JP)

(73) Assignee: Kabushiki Kaisha Isowa (JP)

( * ) Notice: Subject to any disclaimer, the term of this patent is extended or adjusted under 35 U.S.C. 154(b) by 0 days.

(21) Appl. No.: 09/322,823

(22) Filed: May 28, 1999

(30) Foreign Application Priority Data

Jul. 15, 1998 (JP) ..... 10-200800

(51) Int. Cl.[7] ..... B30B 3/00

(52) U.S. Cl. ..... 425/186; 425/194; 425/367; 425/369; 425/DIG. 235; 156/462

(58) Field of Search ..... 425/186, 193, 425/194, 367, 369, DIG. 235; 100/176; 156/462, 474

(56) References Cited

U.S. PATENT DOCUMENTS 4,245,975 * 1/1981 Hattori ..... 425/363
4,629,526 12/1986 Kanda ..... 156/210
4,632,655 * 12/1986 Benkwitz ..... 425/186
5,083,911 * 1/1992 Hisaeda et al. ..... 425/84
5,150,514 * 9/1992 Seki et al. ..... 29/824
5,340,432 8/1994 Schulz et al. ..... 156/472

FOREIGN PATENT DOCUMENTS 439035 7/1991 (EP) .

* cited by examiner

*Primary Examiner*—James P. Mackey
*Assistant Examiner*—Donald Heckenberg
(74) *Attorney, Agent, or Firm*—Morrison Law Firm

(57) ABSTRACT

A corrugating roller unit is moved smoothly between a first reference plane and a second reference plane at different heights by a roll-out apparatus having a set of moving support device. A first moving support device supports the corrugating roller unit when the corrugating roller unit is in contact with the first reference plane. A second moving support device supports the corrugating roller unit when the corrugating roller unit is in contact with the second reference plane. A positioning device keeps the second moving support device in contact with the second reference plane when the second moving support device is providing the support for the corrugating roller unit. When the second moving support device moves the second reference plane to the first reference plane, the positioning device prevents the second moving support device from restricting movement of the corrugating roller unit. The resulting corrugating roller unit is inexpensive and does not require floor construction work at a corrugated cardboard production plant.

20 Claims, 11 Drawing Sheets

ROLL-OUT APPARATUS FOR CORRUGATING ROLLER

BACKGROUND OF THE INVENTION

The present invention relates to a roll-out apparatus for corrugating rollers of a corrugation device. More specifically, the present invention relates to a roll-out apparatus for corrugating rollers used in single facers that produce single-faced corrugated fiberboard. A liner is adhered to a corrugated core paper passed between a pair of corrugating rollers, each having corrugations formed on their outer perimeter surface.

A conventional single facer creates single-faced corrugated cardboard in which a liner is adhered at the peaks of the waveform pattern formed on a corrugated core paper. A first corrugating roller and a second corrugating roller have waveform corrugations on their outer perimeter surfaces. The corrugating rollers are vertically rotatably disposed such that the corrugations mesh with each other. A press roller presses against the second roller. The core paper and the liner are interposed between the second roller and the press roller. The core paper is fed between the first corrugating roller and the second corrugating roller to form flutes in a prescribed manner. A starch-based adhesive is applied to the peaks of the waveform pattern by an adhesive application roller disposed on an adhesive application mechanism. A liner is fed to the opposite side of the core paper via a press roller. This liner is interposed between the press roller and the second corrugating roller so that it is pressed against the peaks of the core paper, thus forming a single-face corrugated fiberboard.

In the conventional single facer described above, the corrugating roller must be replaced periodically due to wear on the waveform flutes over time. Also, the corrugating rollers are replaced with corrugating rollers having different types of waveform flutes when an order is placed for different types of single-face corrugated fiberboard. Due to restrictions imposed by the mechanisms of the device, replacing the corrugating rollers is extremely complicated and time-consuming when performed within the device. Thus, structures where the corrugating rollers are pulled out from the main device unit using a roll-out apparatus have been proposed to allow the corrugating rollers to be replaced outside the device.

In the conventional roll-out apparatus described above, the corrugating rollers are disposed inside the main device unit, which includes various preheaters, adhesive application mechanisms, and the like. The movable sections of the corrugating rollers are connected to a carriage that moves the rollers in and out of the main unit. A frame projects from the carriage and the two corrugating rollers are rotatably disposed on this frame to form a modular unit. To replace the corrugating rollers, the rollers are brought out from the device by pulling out the carriage. This makes it possible to replace the corrugating rollers in a short period of time outside of the device so that the other mechanisms do not obstruct the process. After replacing the corrugating rollers, the carriage is moved back into its operational position to restore the corrugating rollers back inside the device.

When installing the conventional single facer described above in a plant, the single facer is unable to be directly installed on the plant floor because vibrations and the like prevent the accurate operation of the device. Moreover, installing the device level is made difficult. For this reason, a machine base is generally installed on the floor of the plant. The single facer is then installed on this machine base. Since this results in a prescribed offset between the plant floor and the machine base, it is difficult to implement a roll-out apparatus as described above wherein a movable carriage is disposed to allow replacement of corrugating rollers. The use of a carriage requires the upper surface of the base of a machine to be at the same level as the floor of the plant. Major construction work would be required to modify the floor, thus increasing the costs involved in installing the single facer. Another major difficulty that has been discovered is that when the single facer itself is to be replaced, more construction is required on the floor of the plant if the specifications of the new single facer are different from the single facer being replaced.

An air-floatation method has been proposed where high-pressure air is blown up from a bottom surface of the unit containing the corrugating rollers. The force of the high-pressure air makes the unit movable. With this method, the unit can be moved even if there is an offset. This air-floatation method, however, requires accessory equipment such as a high-pressure air source, making the device larger and increasing production costs.

OBJECTS AND SUMMARY OF THE INVENTION

It is an object of the present invention is to provide a roll-out apparatus for corrugating rollers in a single facer device which overcomes the foregoing problems.

It is a further object of the present invention to provide an inexpensive roll-out apparatus for corrugating rollers in single facer devices that does not require floor construction work or the like.

It is another object of the present invention to provide an inexpensive roll-out apparatus for corrugating rollers in a single facer device which allows a corrugating roller unit to be moved smoothly between a first reference plane and a second reference plane, between which exists a prescribed offset.

Briefly stated, the present invention provides a corrugating roller unit which is moved smoothly between a first reference plane and a second reference plane at different heights by a roll-out apparatus having a set of moving support means. A first moving support means supports the corrugating roller unit when the corrugating roller unit is in contact with the first reference plane. A second moving support means supports the corrugating roller unit when the corrugating roller unit is in contact with the second reference plane. A positioning means keeps the second moving support means in contact with the second reference plane when the second moving support means is providing the support for the corrugating roller unit. When the second moving support means moves the second reference plane to the first reference plane, the positioning means prevents the second moving support means from restricting movement of the corrugating roller unit. The resulting corrugating roller unit is inexpensive and does not require floor construction work at a corrugated cardboard production plant.

According to an embodiment of the present invention, there is provided a roll-out apparatus, for rolling an object between a first reference plane and a second reference plane having an offset therebetween, comprising: a first movable support means for supporting the object on one of a higher and a lower reference plane; a second movable support means for supporting the object on the other of the higher and the lower reference plane; positioning means for locking the second support means when the object is supported thereon; and the positioning means permitting retraction of the second support means when the object is support on the first support means, whereby the second moving support means is prevented from restricting movement of the object According to another embodiment of the present invention, there is provided a corrugating roller roll-out apparatus, for use in a corrugated cardboard production device, comprising: a corrugating roller unit rotatably supporting a rolling mechanism; means for moving the corrugating roller unit between a first reference plane and a second reference plane, wherein movement between the first reference plane and the second reference plane moves the corrugating roller unit relative to the corrugated cardboard production device, thereby permitting access to the rolling mechanism; a first moving support means on the corrugating roller unit movably supporting the corrugating roller unit while the corrugating roller unit is on the first reference plane; a second moving support means on the corrugating roller unit movably supporting the corrugating roller unit while the corrugating roller unit is on the second reference plane; a positioning means for keeping the second moving support means in contact with the second reference plane when the corrugating roller unit is on the second reference plane; and the positioning means preventing the restriction of movement of the corrugating roller unit by the second moving support means when the corrugating roller unit is on the first reference plane.

According to a further embodiment of the present invention, there is provided a device for making a corrugated cardboard comprising: a first corrugating roller having a first waveform corrugation on its outer perimeter surface; a second corrugating roller having a second waveform corrugation on its outer perimeter surface; the first waveform corrugation and the second waveform corrugation meshing together, whereby a prescribed corrugation is formed on a core paper when the core paper is passed between the first corrugating roller and the second corrugating roller; a corrugating roller unit rotatably supporting the first corrugating roller and the second corrugating roller; means for moving the corrugating roller unit between a first reference plane and a second reference plane, wherein movement between the first reference plane and the second reference plane moves the corrugating roller unit relative to the corrugated cardboard production device, thereby permitting access to the rolling mechanism; a first moving support means on the corrugating roller unit movably supporting the corrugating roller unit while the corrugating roller unit is on the first reference plane; a second moving support means on the corrugating roller unit movably supporting the corrugating roller unit while the corrugating roller unit is on the second reference plane; a positioning means for keeping the second moving support means in contact with the second reference plane when the corrugating roller unit is on the second reference plane; and the positioning means preventing the restriction of movement of the corrugating roller unit by the second moving support means when the corrugating roller unit is on the first reference plane.

In order to achieve the objects described above, the present invention provides a corrugating roller roll-out apparatus for single facers. In a single-facer for making single-face corrugated cardboard, a prescribed corrugation is formed on a core paper passed between a first corrugating roller, having an outer perimeter surface on which waveform corrugations are formed, and a second corrugating roller, having an outer perimeter surface on which waveform corrugations meshing with the corrugations formed on the first corrugating roller are formed. A liner is adhered to the corrugated core paper by applying adhesive to the peaks of the corrugation and pressing the liner together with the core paper.

The corrugating roller roll-out apparatus of the present invention includes a corrugating roller unit rotatably supporting the first roller and the second roller. The unit is separable from a main device unit, and movable between a higher first reference plane and a lower second reference plane, between which there exists an offset.

A first moving support means is disposed on the corrugating roller unit. The first moving support means movably supports the corrugating roller unit while in contact with the first reference plane. A second moving support means is also disposed on the corrugating roller unit. The second moving support means comes into contact with and moves away from the second reference plane. When the first moving support means moves away from the first reference plane, the second moving support means comes into contact with the second reference plane and provides movable support for the corrugating roller unit.

A positioning means is disposed on the corrugating roller unit to keep the second moving support means in contact with the second reference plane when movable support is provided for the corrugating roller unit. When the second moving support means moves from the second reference plane to the first reference plane, the positioning means prevents the second moving support means from restricting movement of the corrugating roller unit.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
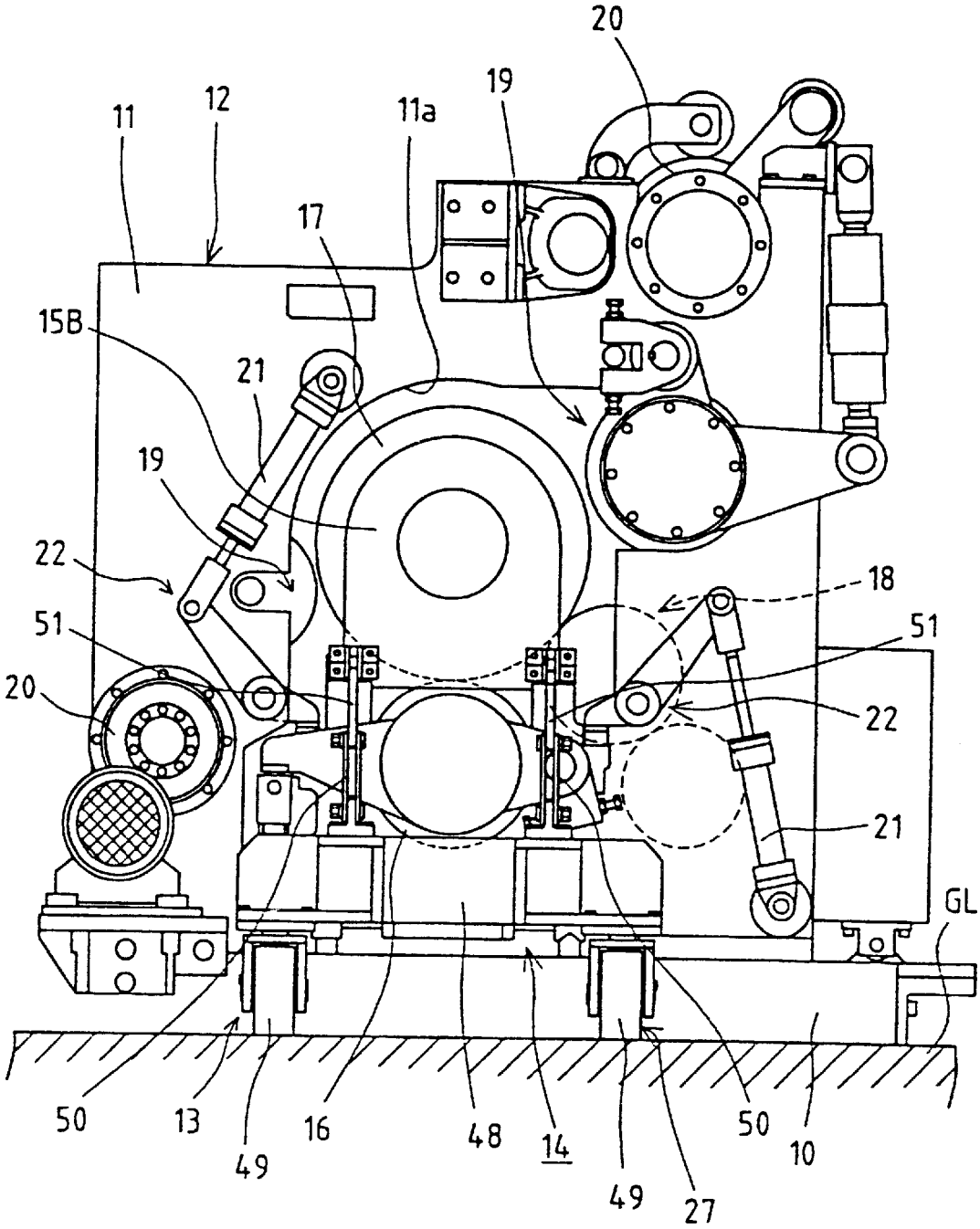
FIG. 1 is a front-view of a single-facer according to an embodiment of the present invention.

Referring to FIG. 1, a single facer according to an embodiment of the present invention has a horizontal machine base 10 mounted on a plant floor GL at a prescribed elevation offset from plant floor GL. A pair of main frames 11 (only one is shown in the figure) project from machine base 10. Frames 11 are separated by a prescribed longitudinal distance perpendicular to the direction in which sheets are fed. Main frames 11 form a main device unit 12. Each main frame 11 has an opening 11*a* with prescribed dimensions. A corrugating roller unit 14 is longitudinally movable, separate from main device unit 12. Corrugating roller unit 14, positioned at the alignment of openings 11*a,* includes a corrugating roller roll-out apparatus (hereinafter referred to as "roll-out apparatus") 13.

Figure 2:
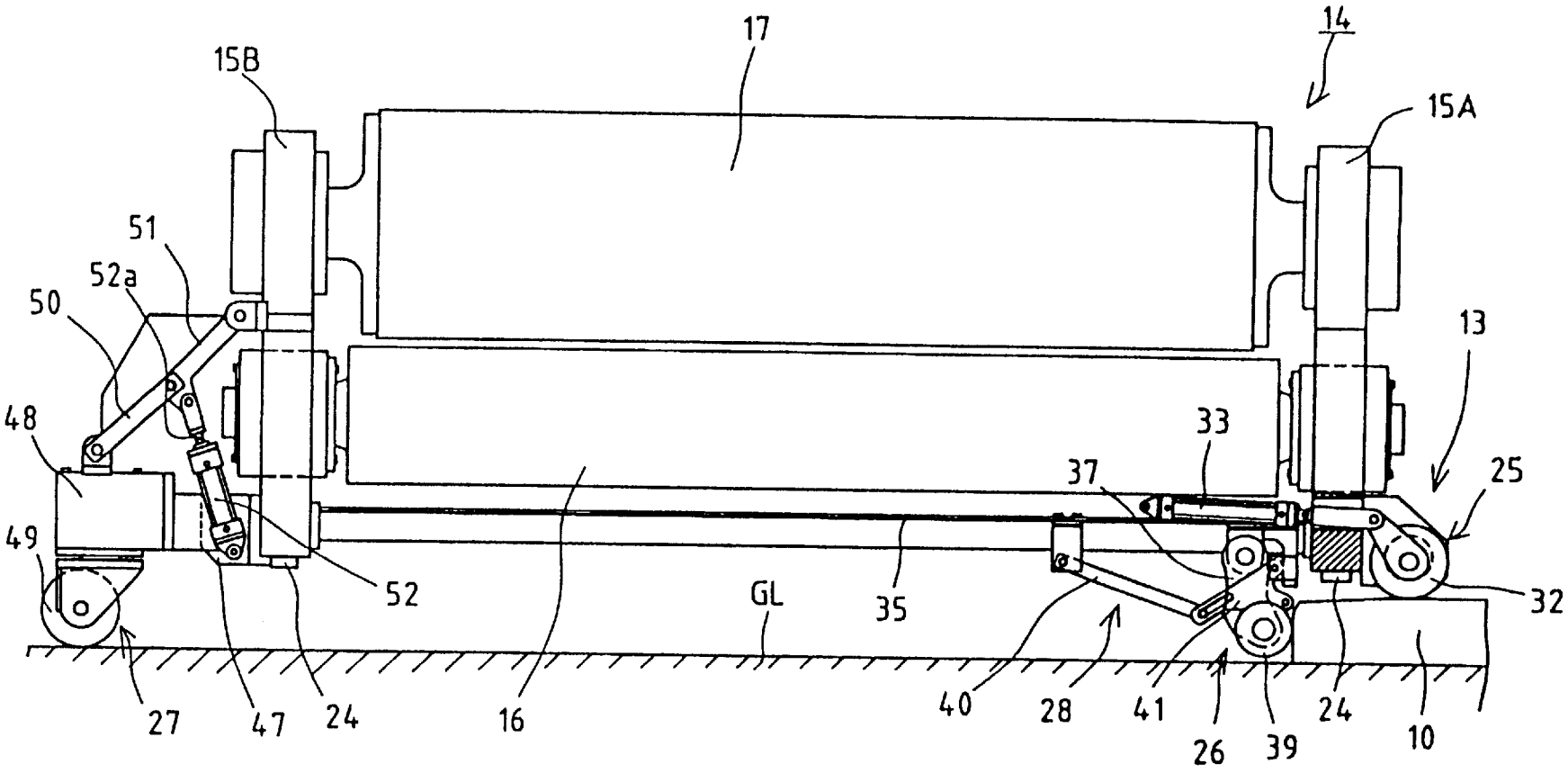
FIG. 2 is a side-view drawing of a corrugating roller unit, including a corrugating roller roll-out apparatus, of the single facer of FIG. 1.

Referring to FIG. 2, corrugating roller unit 14 includes a pair of secondary frames 15*a* and 15*b* separated by a prescribed longitudinal interval. A first corrugating roller 16, having an outer perimeter surface with waveform flutes, and a second corrugating roller 17, also having an outer perimeter surface with waveform flutes, rotatably extend longitudinally between secondary frames 15*a* and 15*b*. A rotation axis of first corrugating roller 16 is positioned directly below a rotation axis of second corrugating roller 17. The respective waveform flutes of first corrugating roller 16 mesh with those of second corrugating roller 17. As described later, corrugating roller unit 14 can be moved from the active position (first reference plane) on machine base 10 in main device unit 12 to an external roll-out section (second reference plane) on plant floor GL. This freedom of movement allows easy replacement of corrugating rollers 16 and 17 outside of the device.

Referring back to FIG. 1, an adhesive application mechanism 18 is between primary frames 11 of main device unit 12. Adhesive application mechanism 18 is positioned diagonally downward from second corrugating roller 17, and to the side of first corrugating roller 16 of corrugating roller unit 14. Paper is sent from a paper feeding source, not shown in the figure, to a region where first corrugating roller 16 and second corrugating roller 17 mesh so that a prescribed corrugation results on the core paper. Adhesive application mechanism 18 applies adhesive to the peaks of the corrugation. Bonding means 19, between primary frames 11 near second corrugating roller 17, and a liner fed from opposite the core paper, is adhered and pressed against the corrugation peaks of the core paper between second corrugating roller 17 and bonding means 19. A single-face corrugated cardboard is thus formed. Furthermore, a plurality of roller-shaped preheaters 20, located between primary frames 11, heat the core paper and the liner, preferably using steam.

On the outside of primary frames 11, positioning mechanisms 22, activated by oil hydraulic cylinders 21, arc located on either side of the laterally arranged openings 11*a*. Positioning mechanisms 22 keep corrugating roller unit 14 at a fixed position in the active section.

Figure 3:
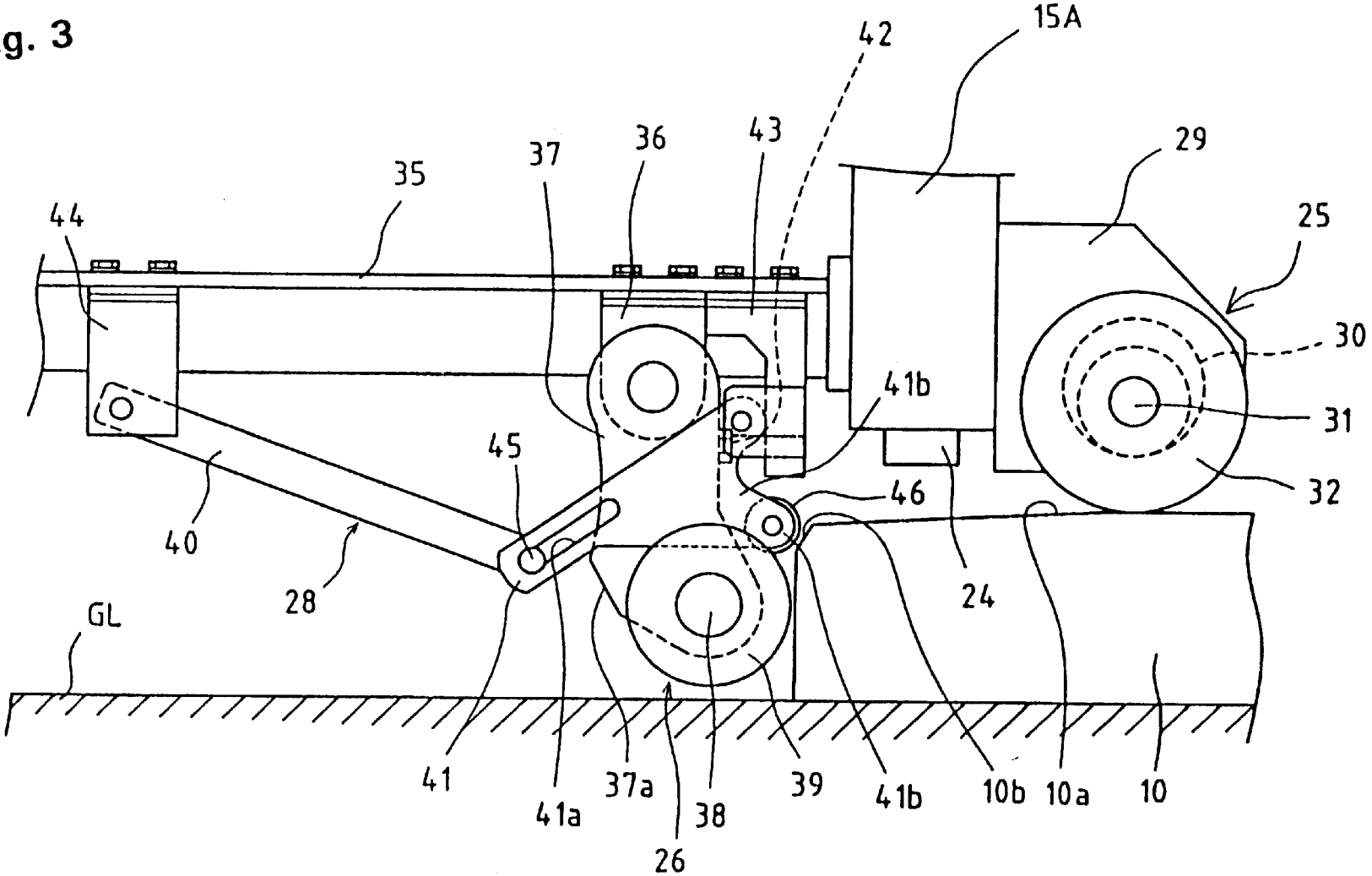
FIG. 3 is a side-view drawing of the first moving support means and the second moving support means of the single facer of FIG. 1.

Referring to FIG. 3, a first sloped surface 10*a* is formed at the upper surface near the end of machine base 10 on the side from which corrugating roller unit 14 rolls out. A second sloped surface 10*b,* having a larger sloping angle than that of first sloped surface 10*a,* is formed between the bottom end of first sloped surface 10*a* and the edge of the outer end.

Figure 4A:
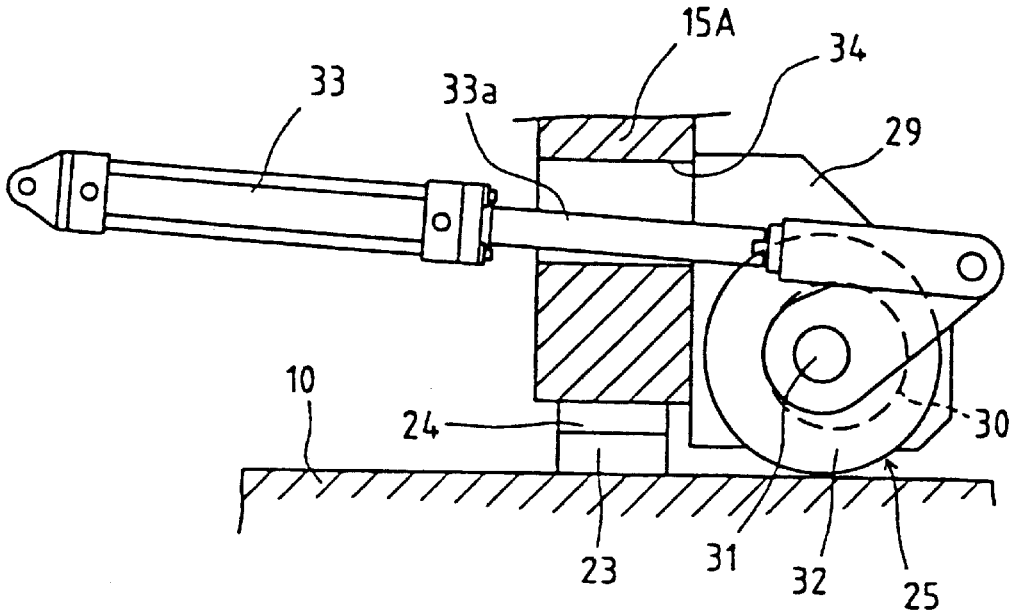
FIGS. 4(*a*) and 4(*b*) are partial cross-sectional drawings describing the operation of the first moving support means.
Figure 4B:
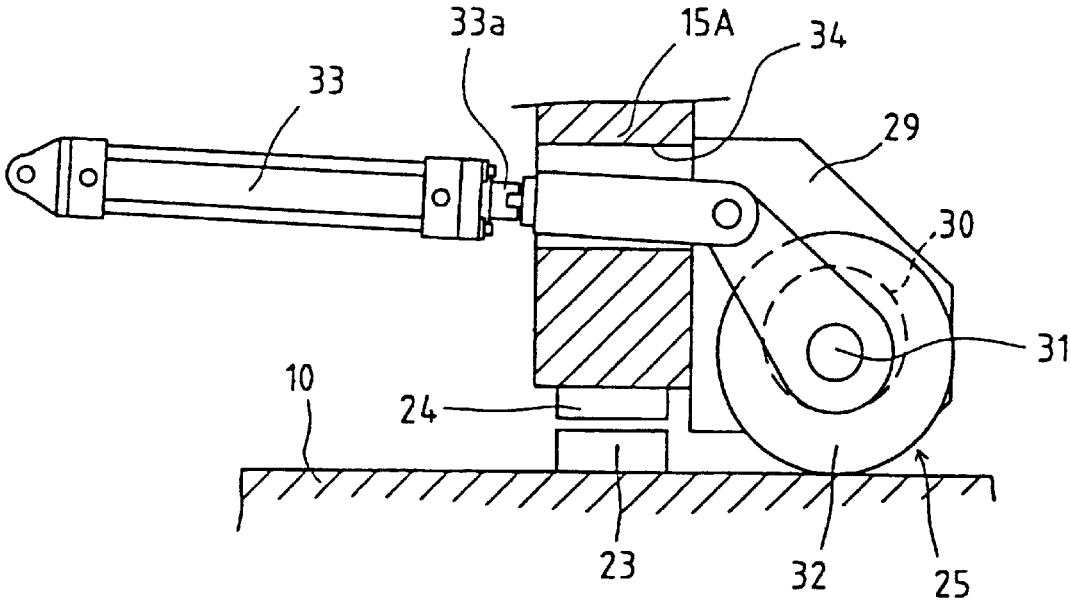

Referring to FIGS. 4(*a*), 4(*b*), 7(*a*),. and 7(*b*), installation sections 23 project from machine base 10 at positions corresponding to secondary frames 15*a* and 15*b* of corrugating roller unit 14 when it is rolled into the active section. Installation sections 23 are positioned so that a mounting section 24, projecting from the bottom surface of secondary frames 15*a* and 15*b* is in close proximity to installation sections 23.

The Corrugating Roller Roll-out Apparatus

Referring again to FIG. 2, corrugating roller roll-out apparatus 13 includes a first moving support means 25 and a second moving support means 26 located on a drive-side secondary frame 15 opposite from the roll-out side. A third moving support means 27 is located on an operation-side secondary frame 15B on the roll-out side. Roll-out apparatus 13 also includes positioning means 28, which keeps second moving support means 26 at a support position.

The First Moving Support Means

A drive-side bracket 29 is positioned roughly at a lateral midpoint of drive-side secondary frame 15A. Drive-side bracket 29 extends outward by a prescribed distance. Drive-side bracket 29 is rotatably inserted in an eccentric housing 30.

Referring to FIG. 3, eccentric housing 30 includes an axis 31 at a position eccentric by a prescribed amount from the center of rotation of eccentric housing 30. At the ends of axis 31, extending laterally out from eccentric housing 30, first wheels 32 are rotatably disposed. First wheels 32 serve as part of first moving support means 25.

Referring to FIGS. 4(*a*) and 4(*b*), on the inside of drive-side secondary frame 15A, a drive-side oil hydraulic cylinder 33 is rotatably disposed. A piston rod 33*a* of cylinder 33 extends out through an opening 34 formed on drive-side secondary frame 15A. Piston rod 33*a* connects to eccentric housing 30. The action of drive-side oil hydraulic cylinder 33 causes eccentric housing 30 to rotate forward or backward over a prescribed angle range relative to drive-side bracket 29. By using drive-side oil hydraulic cylinder 33 to rotate eccentric housing 30 forward or backward, first wheels 32 are raised or lowered by an amount determined by the eccentricity between the axis of eccentric housing 30 and axis 31. As described later, when first wheels 32 are raised, drive-side secondary frame 15A, which is moved down relative to first wheels 32, is mounted on machine base 10 (FIG. 4(*a*)). Conversely, when first wheels 32 are lowered, drive-side secondary frame 15A, which is moved up relative to first wheels 32, is moved up away from machine base (FIG. 4(*b*)).

The Second Moving Support Means

Figure 5:
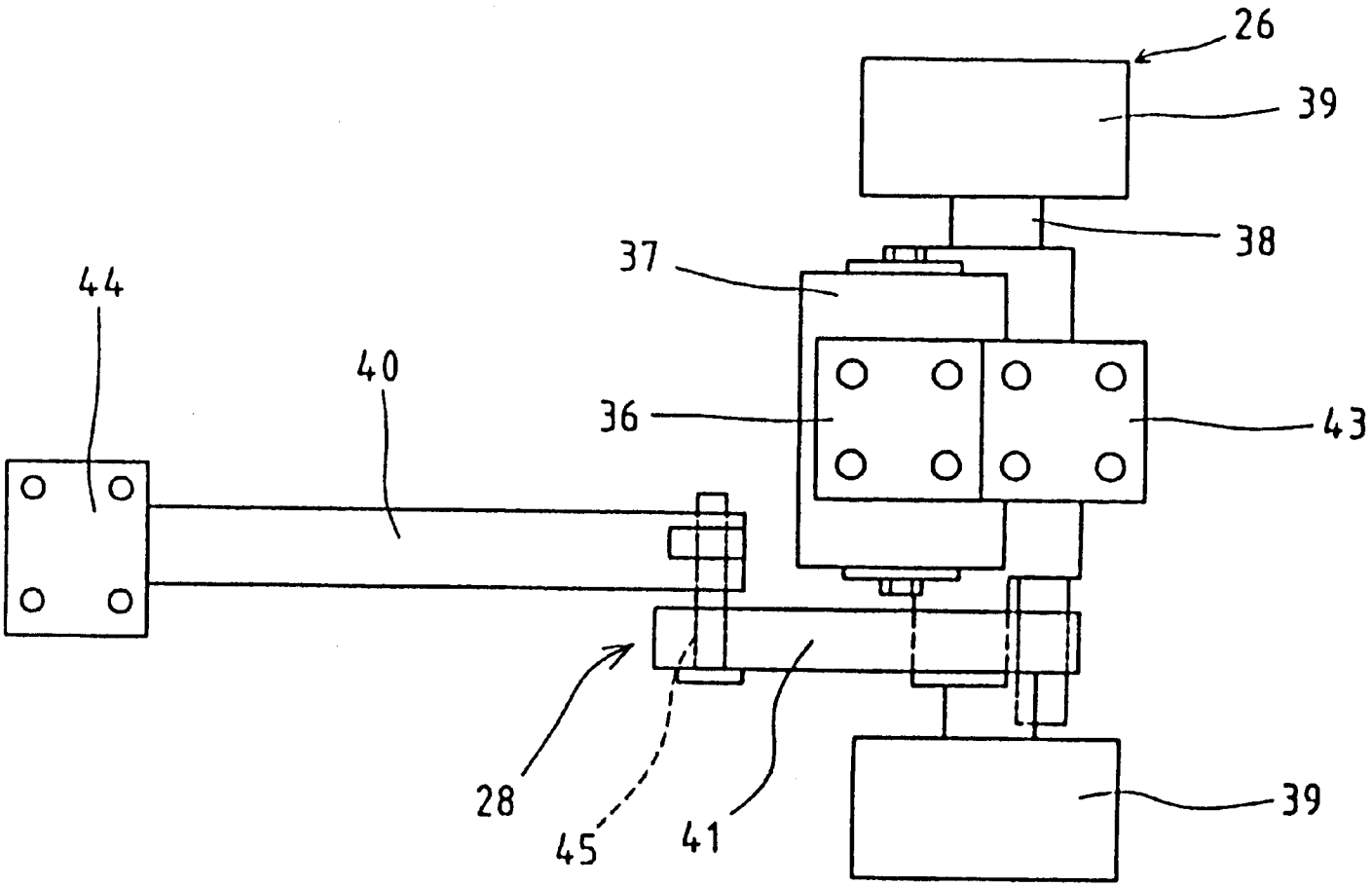
FIG. 5 is a plan drawing of the second moving support means.

Referring to FIGS. 3 and 5, a first bracket 36 projects from a horizontally disposed support section 35 inward from drive-side secondary frame 15A. A holder 37, which is part of second moving support means 26, is pivotably disposed on first bracket 36. The free end of holder 37 is formed so that an axis 38 can pass through laterally.

Second wheels 39, rotatably disposed at the ends of axis 38, form part of second moving support means 26. Holder 37 hangs down from first bracket 36 due to its own weight. From this orientation, holder 37 provides movable support for corrugating roller unit 14 when second wheels 39 come into contact with plant floor GL. With holder 37 in a vertical orientation, the center of axis 38 is on the side of drive-side secondary frame 15A (first wheels 32) relative to a perpendicular line passing through the pivot point of holder 37. The weight of corrugating roller unit 14 applied to second wheels 39 causes holder 37 to pivot toward first wheels 32. When second wheels 39 provide movable support for corrugating roller unit 14, the structure is set up so that first wheels 32 are at a height where they come into contact with first sloped surface 10*a* of machine base 10.

Positioning Means for the Second Moving Support Means

Positioning means 28, on support member 35, includes a pair of link members 40 and 41 and a stopper 42. Positioning means 28 keeps second moving support means 26 at a support position, where second moving support means 26 provides movable support for corrugating roller unit 14. Positioning means 28 also allows second support means 26 to pivot to a non-support position. A second bracket 43 is disposed on a support member interposed between first bracket 36 and drive-side secondary frame 15A. Stopper 42, which can come into contact with outer surface of the holder 37 (the side facing the drive-side secondary frame 15A), is disposed on second bracket 43. Stopper 42 acts to restrict the pivoting of holder 37 toward first wheels 32. Stopper 42 is positioned so that its position relative to second bracket 43 can be adjusted, thus permitting variable restriction on holder 37.

One longitudinal end of first link member 40 is rotatably attached to a third bracket 44, projecting from support member 35 on the side of holder 37 opposite from first wheels 32. A free end (the other longitudinal end) of first link member 40 is positioned near an inward side of holder 37. A longitudinal end of second link member 41 is rotatably attached to second bracket 43. A free end (the other longitudinal end) of second link member 41 extends inward from holder 37. A slot 41*a* is formed near the free end of second link member 41 and a link pin 45, on the free end of first link member 40, is slidably inserted in slot 41*a*. This provides a moveble connection between first link member 40 and second link member 41. When link members 40 and 41 are hanging downward of their own weight, the free end of first link member 40 extends to a restricted position where it is close to and can come into contact with the inward side of holder 37. This restricts holder 37 from pivoting away from first wheels 32.

Figure 6:
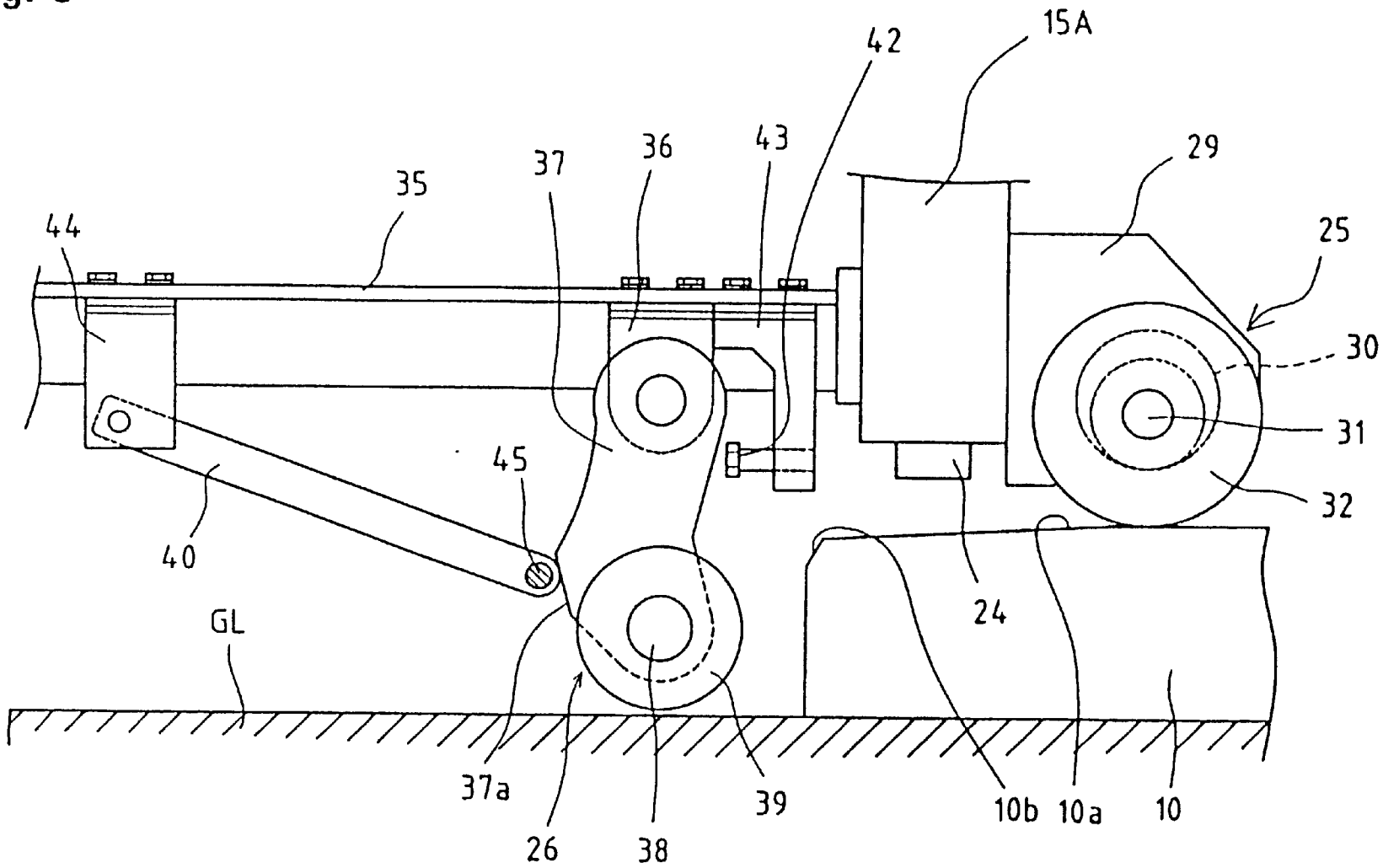
FIG. 6 describes the relationship between the first moving support means and the positioning means.

Referring to FIG. 6, a sloped surface 37*a* is formed on an inward surface of holder 37 where it comes into contact with the free end of first link member 40. Sloped surface 37*a* slopes outward and downward as shown in the figure. When holder 37, which contacts first link member 40 through sloped surface 37*a,* tries to pivot inward, first link member 40 prevents holder 37 from pivoting upward to a permissive position.

A support section 41*b,* on second link member 41, extends toward drive-side secondary frame 15A. Support section 41*b* rotatably supports a follower 46. When link members 40 and 41 hang down from their own weight, follower 46 contacts second sloped surface 10*b* formed on machine base 10. As corrugating roller unit 14 moves from the roll-out section to the active section, follower 46 contacts second sloped surface 10*b.* Second link member 41 rotates in the clockwise direction in FIG. 3. As second link member 41 rotates, first link member 40 rotates in the counterclockwise direction in FIG. 3 and holder 37 pivots from the restricted position to the upper, permissive position. Thus, when second wheels 39 contact machine base 10, holder 37 pivots away from machine base 10, as described later, and allows second wheels 39 to ride up onto the upper surface of machine base 10.

The Third Moving Support Means

Figure 7A:
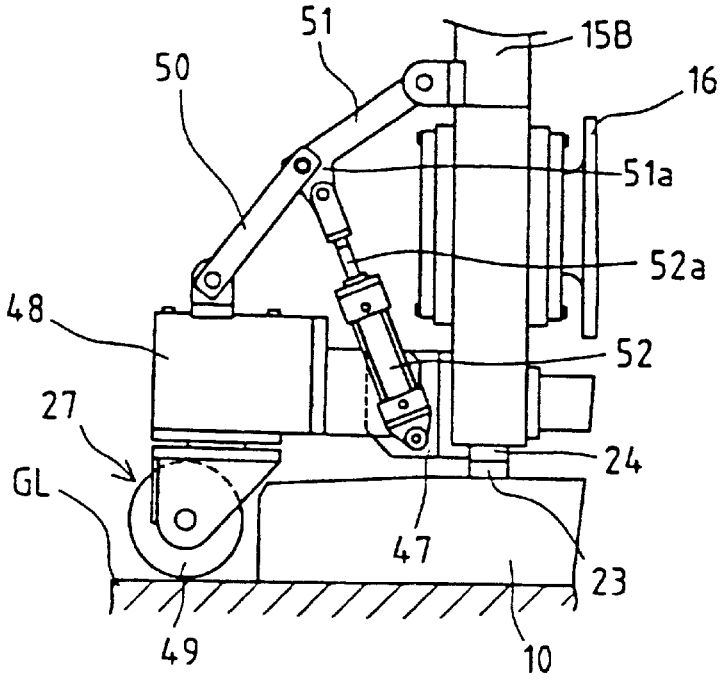
FIGS. 7(*a*) and 7(*b*) describe the operation of the third moving support means of the single facer of FIG. 1.
Figure 7B:
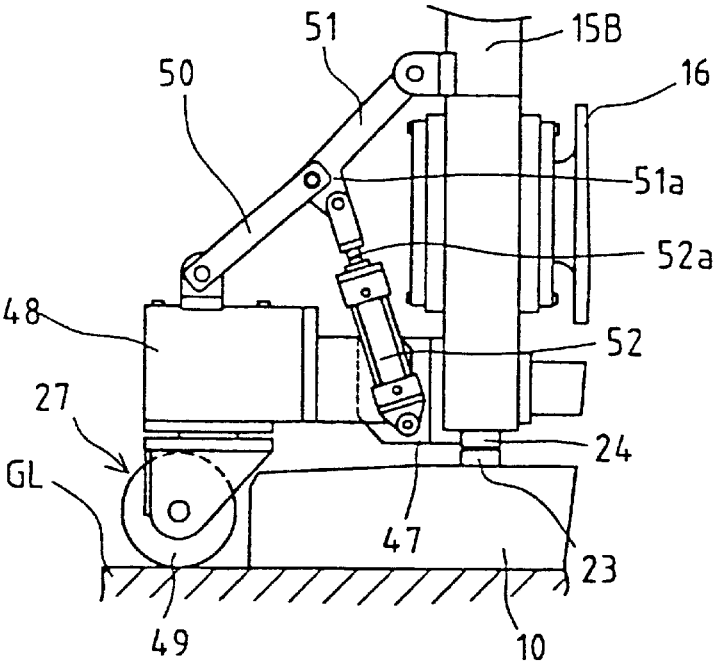

Referring to FIGS. 7(*a*) and 7(*b*), a support member 48 is rotatably attached to operation-side secondary frame 15B with an operation-side bracket 47. A pair of laterally separated third wheels 49, forming part of a third moving support means 27, are rotatably disposed on support member 48. The bottom ends of a pair of laterally separated first connecting members 50 pivotably attach to support member 48. The upper ends of first connecting members 50 pivotably attach to second connecting members 51. The upper ends of the second connecting members 51 pivotably attach to corresponding positions on operation-side secondary frame 15B. A support piece 51*a,* located near the bottom end of each connecting member 51, connects to a piston rod 52*a* of an operation-side oil hydraulic cylinder 52. The bottom end of oil hydraulic cylinder 52 pivotably connects to operation-side bracket 47. When operation-side oil hydraulic cylinder 52 is activated. Connecting members 50 and 51 are pivoted so that third wheels 49 are raised and lowered relative to plant floor GL. As described later, when third wheels 49 are raised, operation-side secondary frame 15B, which is moved down relative to third wheels 49, is mounted on machine base 10 (FIG. 7(*a*)). Conversely, when third wheels 49 are lowered, operation-side secondary frame 15B, which is moved up relative to third wheels 49, is raised upward from machine base 10 (FIG. 7(*b*)).

When piston rod 52*a* of operation-side oil hydraulic cylinder 52 is completely retracted, the connecting sections of connecting members 50 and 51 are bent down to a position below a line connecting the pivot points of connecting members 50 and 51. Thus, connecting members 50 and 51 cannot bend down further even if, for example, oil hydraulic pressure in operation-side oil hydraulic cylinder 52 is lost. This prevents third wheels 49 from moving up and corrugating roller unit 14 from dropping to plant floor GL when corrugating roller unit 14 is moved.

The following is a description of the operations performed by the single-facer corrugating roller roll-out apparatus according to the embodiment described above.

Moving the Corrugating Roller Unit from an Active Section to a Roll-out Section

Referring to FIGS. 4(*a*), 7(*a*), and 8(*c*), when the single-facer is active, corrugating roller unit 14 is positioned in the active section on machine base 10 so that corrugating roller unit 14 is mounted on mounting sections 24 of secondary frames 15A and 15B corresponding to installation sections 23. Third wheels 49 of third moving support means 27 are disposed on plant floor GL away from machine base 10 toward the roll-out side. Second wheels 39 of second moving support means 26 contact the upper surface of machine base 10. Follower 46 of second link member 41 of positioning means 28 contacts the upper surface of machine base 10, keeping first link member 40 in a permissive position.

When upper and lower corrugating rollers 16 and 17 of the single-facer must be replaced due to wear in the waveform flutes, or if the rollers must be replaced with rollers having different waveform corrugations due to a change in order from the client, corrugating roller unit 14 is moved from the active section to the roll-out section.

First, the drive-side and operation-side oil hydraulic cylinders 33 and 52 activate in tandem so that piston rods 33*a* and 52*a* retract. In moving support means 25, this retraction causes eccentric housing 30 to rotate relative to drive-side bracket 29.

Referring to FIG. 4(*b*), first wheels 32 are lowered to contact the upper surface of machine base 10, causing drive-side secondary frame 15A to be lifted.

Referring to FIG. 7(*b*), in third moving support means 27, connecting members 50 and 51 are bent downward, causing support member 48 to pivot relative to operation-side bracket 47. Third wheels 49 lower to contact plant floor GL. Operation-side secondary frame 15B is then raised up. As a result, mounting sections 24 of secondary frames 15A and 15B raise up from installation sections 23 of machine base 10. Corrugating roller unit 14 is now movably supported by first wheels 32 and third wheels 49.

When corrugating roller unit 14 is moved toward the operation side in this state, corrugating roller unit 14 is pulled out from the active section to the roll-out section. As the unit is pulled out and second wheels 39 move away from the operation-side end of machine base 10, holder 37, on which wheels 39 are disposed, drop down due to its own weight and is oriented in a perpendicular direction (see FIG. 8(*b*)). The outer surface of holder 37 contacts stopper 42. This causes holder 37 to be positioned at the support position. As corrugating roller unit 14 is moved further, follower 46 of second link member 41 moves away from the operation-side end of machine base 10. Second link member 41 pivots counterclockwise due to its own weight and first link member 50 pivots clockwise from the permissive position to the restricted position. The free end of first link member 50 extends to the restricted position where it contacts the inward side of holder 37, which is kept in a state where it cannot tilt (see FIG. 8(*a*)).

As first wheels 32 move along first sloped surface 10*a* of machine base 10, corrugating roller unit 14 lowers slightly. Second wheels 39 contact plant floor GL. The drive side of corrugating roller unit 14 is then movably supported by second wheels 39. Thus, corrugating roller unit 14 will subsequently be supported by second wheels 39 and third wheels 49. With holder 37 oriented perpendicularly, the weight of corrugating roller unit 14 on second wheels 39 will cause a force to be applied on holder 37 so that holder 37 pivots toward a position where it contacts stopper 42. Thus, as corrugating roller unit 14 moves from the active section to the roll-out section, holder 37 pivots away from first wheels 32 and corrugating roller unit 14 is prevented from moving down.

Moving the Corrugating Roller Unit from a Roll-out Section to an Active Section

Once the corrugating rollers have been replaced at the roll-out section of plant floor GL, corrugating roller unit 14 is pushed from the roll-out section to the active section so that it can be restored back to the active section.

Referring to FIG. 6, holder 37 for second wheels 39 receive a force that moves it away from stopper 42. If second wheels 39 ride up on debris on plant floor GL, it is possible for holder 37 to pivot away from stopper 42. However, in roll-out apparatus 13, first link member 40 of positioning means 28 is extended to the restricted position where it can contact the inward side of holder 37. This reliably prevents holder 37 from pivoting inward and tilting. Also, since first link member 40 is in contact with the sloped surface of holder 37, the force acting in the direction of causing holder 37 to pivot inward acts to push first link member 40 downward. Thus link member 40 does not move from the restricted position to the upper, permissive position.

Figure 8A:
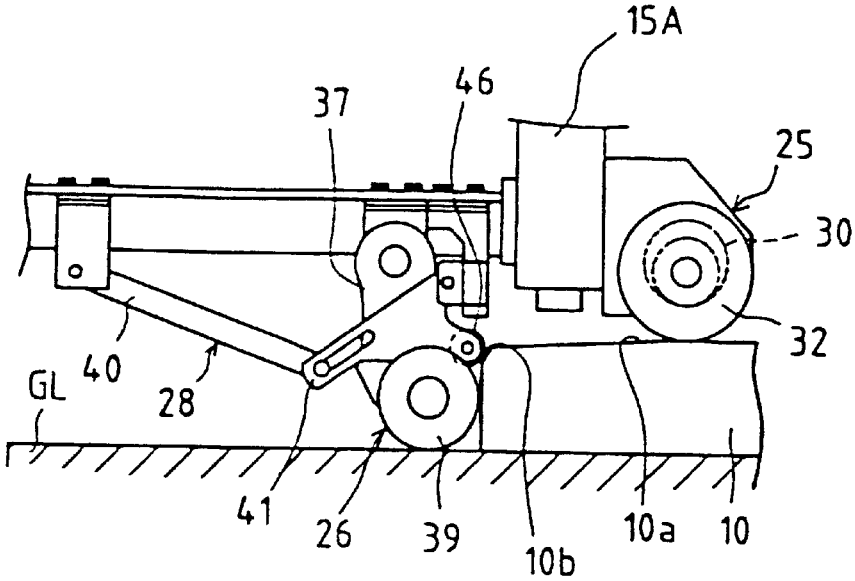
FIGS. 8(*a*), 8(*b*), and 8(*c*) describe the steps involved as the second moving support means and the positioning means moves the corrugating roller unit between the active section and the roll-out section.
Figure 8B:
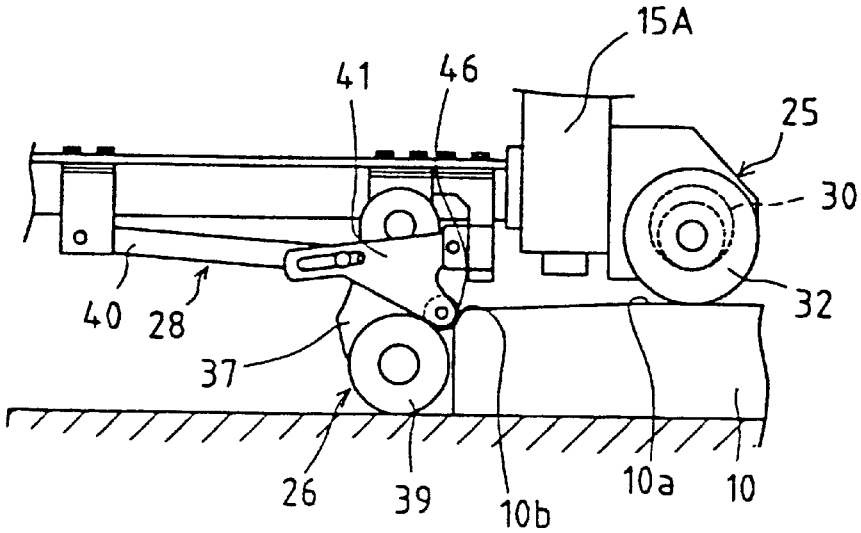
Figure 8C:
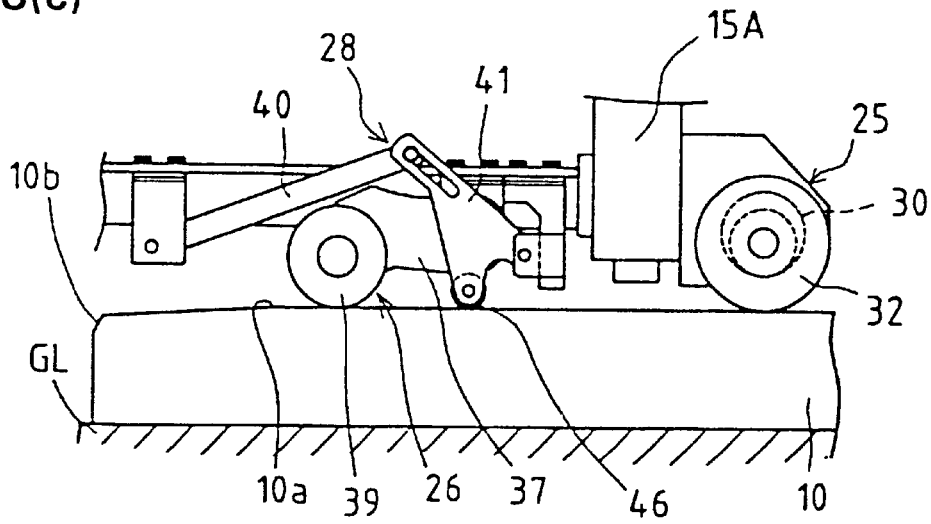

Referring to FIG. 8(*a*), corrugating roller unit 14 is moving while supported by second wheels 39 and third wheels 49 (not shown in the figure). First wheels 32 are moving in contact with first sloped surface 10*a* of machine base 10. This movement causes corrugating roller unit 14 to lift up slightly. Second wheels 39 move away from plant floor GL and corrugating roller unit 14 is movably supported by first wheels 32 and third wheels 49. Next, before second wheels 39 contact the edge of machine base 10, follower 46 of second link member 41 contacts second sloped surface 10*b*.

Referring to FIG. 8(*b*), second link member 41 pivots clockwise. Thus, first link member 40 connected to second link member 41 pivots counterclockwise from the restricted position to the permissive position. Holder 37 is able to pivot inward.

As corrugating roller unit 14 moves, holder 37 slopes inward while second wheels 39 moves successively in contact with the edge of machine base 10, second sloped surface 10*b*, and first sloped surface 10*a*. Thus, second wheels 39 ride smoothly up onto the upper surface of machine base 10 (see FIG. 8(*c*)). Then, corrugating roller unit 14 is stopped when mounting, sections 24 of secondary frames 15*a* and 15*b* of corrugating roller unit 14 are positioned above the corresponding installation sections 23. Next, the drive-side and operation-side oil hydraulic cylinders 33 and 52 activate in tandem in opposite directions so that first wheels 32 and third wheels 49 rise.

Referring to FIGS. 4(*a*) and 7(*a*), the entire corrugating roller unit 14 is lowered and mounting sections 24 are mounted on installation sections 23. This completes the positioning of corrugating roller unit 14 at the active section. Once corrugating roller unit 14 is positioned in the active section of main device unit 12, positioning mechanisms 22 are activated so that corrugating roller unit 14 is reliably fixed at a fixed position.

Alternative Embodiments

The present invention is not restricted to the embodiments described above, and various alternative embodiments can also be implemented.

Figure 9:
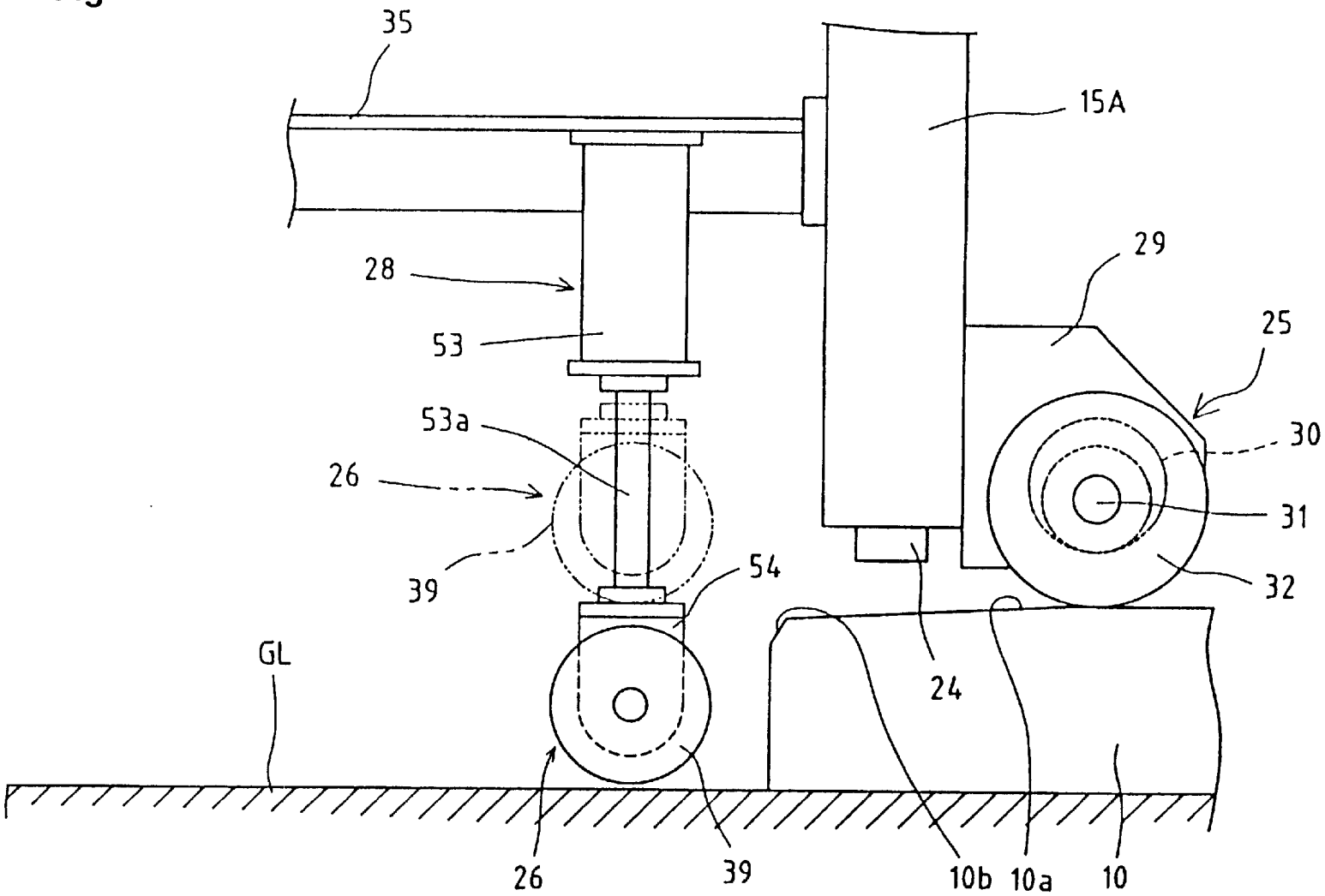
FIG. 9 describes the second moving support means and the positioning means according to a first alternative embodiment of the present invention.

Referring to FIG. 9, a oil hydraulic cylinder 53 is perpendicularly disposed from support member 35 as part of positioning means 28. Second moving support means 26 is positioned on piston rod 53*a*, which points downward from hydraulic cylinder 53. Second moving support means 26 includes a holder 54 connected to piston rod 53*a*. Second wheels 39 are rotatably supported by holder 54. Hydraulic cylinder 53 is activated to place second wheels 39 in contact with plant floor GL, keeping corrugating roller unit 14 in a support position (indicated by solid lines in the figure), where it is movably supported. When piston rod 53*a* retracts, second wheels 39 move to a non-support position (indicated by dotted lines in the figure), where they do not obstruct machine base 10. An oil hydraulic cylinder is preferred as oil hydraulic cylinder 53.

In this first alternative embodiment, when corrugating roller unit 14 is moved from the active section to the roll-out section, second support means 26 moves away from the operation-side end of machine base 10. Hydraulic cylinder 53 activates so that second wheels 39 move from the non-support position to the support position. This movement allows the drive side of corrugating roller unit 14 to be movably supported by second wheels 39. When corrugating roller unit 14 moves from the roll-out section to the active section, first wheels 32 of first moving support means 25 contacts the top of machine base 10. Hydraulic cylinder 53 activates so that second wheels 39 move from the support position to the non-support position. As a result, the drive side of corrugating roller unit 14 is movably supported by first wheels 32. Movement of corrugating roller unit 14 is not restricted due to second wheels 39 obstructing machine base 10.

Figure 10:
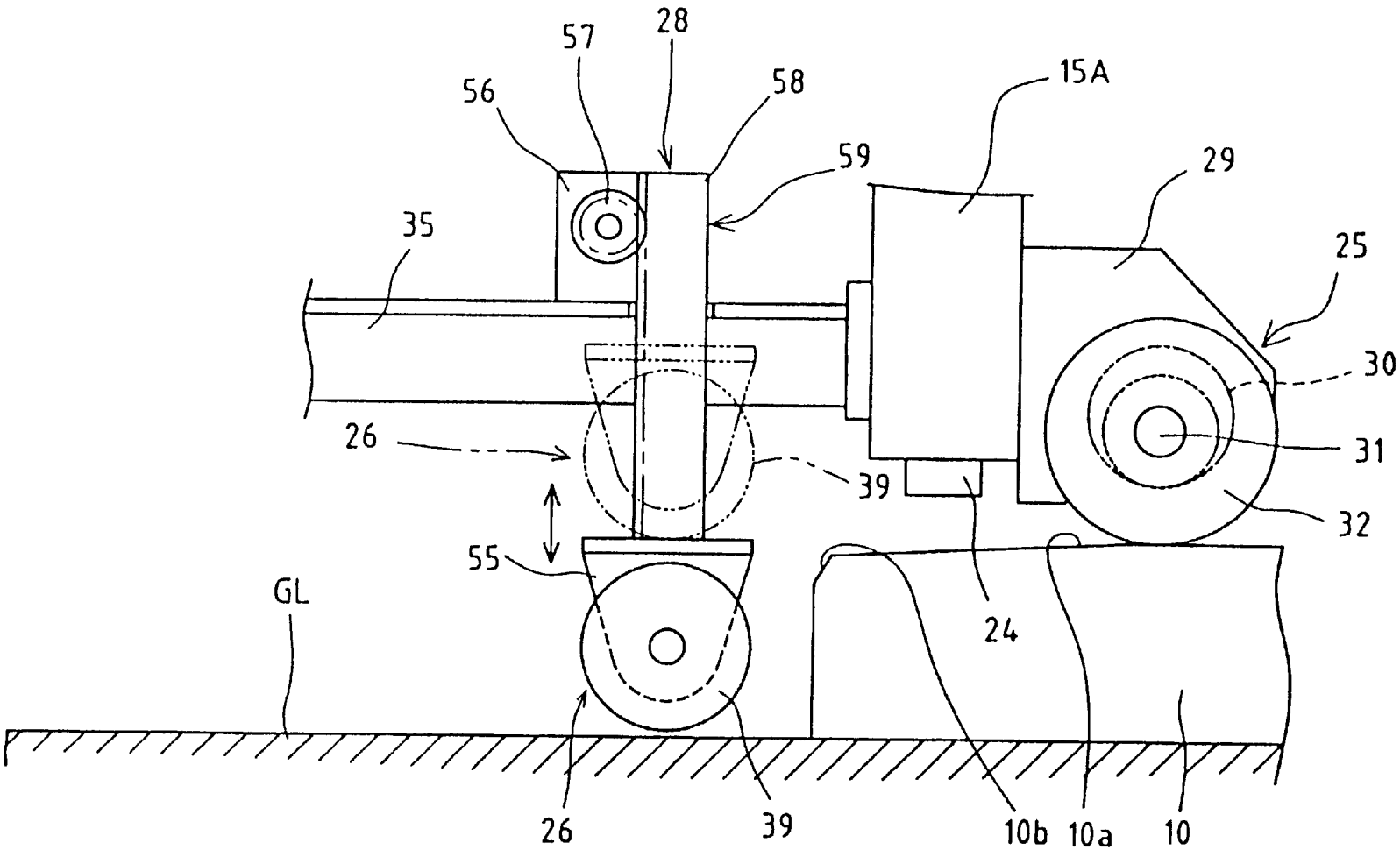
FIG. 10 describes the second moving support means and the positioning means according to a second alternative embodiment of the present invention.

Referring to FIG. 10, in a second alternative embodiment, second wheels 39 of holder 55 are rotatably supported and form part of second moving support means 26. A shaft (not shown in the figure) is disposed on holder 55. Second moving support means 26 moves up and down relative to support member 35 through the shaft. A motor 56, capable of operating forward and in reverse, serves as part of positioning means 28. Motor 56 is disposed on support member 35. Motor 56 and second moving support means 26 connect with a raising/lowering mechanism 59, which includes a pinion 57 disposed on the output shaft of motor 56, and a rack 58, projected from holder 55 and meshing with pinion 57. Motor 56 rotates in a prescribed direction so that second moving support means 26 lowers with raising/lowering mechanism 59. Second wheels 39 contacts plant floor GL, keeping corrugating roller unit 14 at the support position (indicated by the solid lines in the figure), where it is movably supported. When motor 56 is rotated in reverse and second support means 26 is raised, second wheels 39 is moved to a non-support position where it does not obstruct machine base 10.

As with the first alternative embodiment, the second alternative embodiment described above involves moving second wheels 39 from the support position to the non-support position by operating motor 56 forward and in reverse. Thus, corrugating roller unit 14 is moved smoothly from the active section to the roll-out section or from the roll-out section to the active section.

Figure 11:
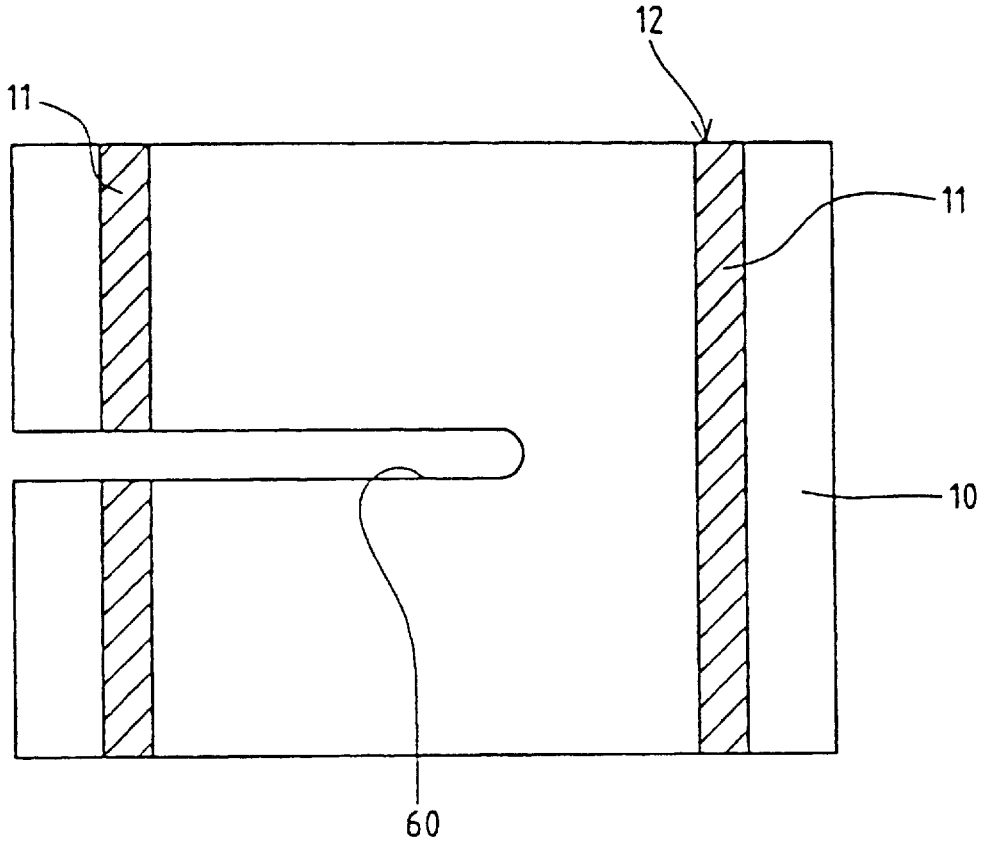
FIG. 11 is a plan view of an alternative embodiment of the machine base.

In the embodiments and alternative embodiments, the roll-out section is described as being outside main device unit 12. Referring to FIG. 11, it is also possible to form a cut-out section 60 in machine base 10 to serve as a roll-out section (the second reference plane). Cut-out section 60 is cut down to the same level as plant floor GL. This way, the roll-out section is disposed in main device unit 12 and the corrugating roller roll-out apparatus can be efficiently implemented. In this case, second moving support means 26 of corrugating roller unit 14 moves cut-out section 60 in main device unit 12. At the end of the movement of second moving support means 26, second wheels 39 move to the support position or the non-support position. This permits corrugating roller unit 14 to move smoothly from the active section to the roll-out section (cut-out section 60) or from the roll-out section (cut-out section 60) to the active section.

The first and third wheels do not have to be structured so that they can be raised and lowered, as described in the embodiments above. It is also possible to have the first and third wheels is a fixed position as long as the corrugating roll unit can be positioned at the active section when the first and third wheel are in contact with the machine base or the plant floor. Alternatively, the entire corrugating roller unit can be raised and positioned using oil hydraulic means or the like. Also, on the operation side of the corrugating roller unit, it is also possible to use, instead of the third moving support means, the first moving support means and the second moving support means as on the drive side, and to have the entire corrugating roller unit move onto the machine base. Furthermore, in the positioning means, the means used to move the first link member between the restricted position and the permissive position does not have to involve the second link member and the follower as described in the embodiments above. For example, elastic means can be used to keep the first link member in the permissive position. By using an appropriate means, the elastic force from the elastic means can be disengaged from the first link member so that the first link member moves to the restricted position due to its own weight.

In the embodiments, the upper-surface plane of the machine base (the active section) on which the single-facer device is installed is described as being higher than the plant floor plane (the roll-out section). It is also possible to have the upper-surface plane of the machine base (the active section) be lower than the plant floor (the roll-out section) in order to have the a lower installation of the single-facer device. Thus, a low second reference plane would be disposed within the main device unit and a high first reference plane would be disposed outside of the main device unit. The roll-out apparatus of the present invention can be used to move the corrugating roller unit smoothly in this case as well. More specifically, the second moving support means is disposed at a position in front of (relative to the direction of movement) the machine base of the corrugating roller unit. The first moving support means is disposed behind the second moving support means. For the machine base, which is lower then the plant floor, the second moving support means is used to movably support the corrugating roller unit while on the plant floor, the first moving support means is used to movably support the unit.

As described above, the single-facer corrugating roll-out apparatus according to the present invention allows the roll-out unit to be smoothly moved between a first reference plane and a second reference plane, even if there is a prescribed offset between the first reference plane and the second reference plane. This eliminates the need to perform large-scale construction on the plant floor on which the single-facer is to be installed. Furthermore, this keeps installation costs down. By forming positioning means from a pair of link members and activating means, the second moving support means can be moved between a support position and a non-support position without the use of driving means. This further reduces the production costs involved in the roll-out apparatus.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A roll-out apparatus, for rolling an object between a first reference plane and a second reference plane having an offset therebetween, comprising:

a first movable support means for supporting said object on one of said first reference plane and said second reference plane;

a second movable support means for supporting said object on the other of said first reference plane and said second reference plane;

a first link member rotatably fastened to said object;

a second link member rotatably fastened to said object;

said second link member being movably connected to said first link member;

an active means on said second link member for detecting the presence or absence of said first reference plane;

pivoting means for pivoting said first link member between a restricting position and a permissive position;

said restricting position holding said second movable support means in place when said object is supported on said second reference plane by said second movable support means;

said permissive position permitting movement of said second movable support means, thereby preventing restriction of movement of said object by said second movable support means when said object is supported by said first movable supports on said first reference plane;

positioning means for locking said second support means when said object is supported thereon;

said positioning means permitting retraction of said second movable support means when said object is supported on said first movable support means, whereby said second movable support means is prevented from restricting movement of the object;

when said active means contacts said first reference plane, said second link member pivots and said first link member moves from said restricting position to said permissive position; and when said active means moves away from said first reference plane, said second link member pivots and said second first link member moves from said permissive position to said restricting position.

2. The roll-out apparatus according to claim 1, wherein said object is a corrugating roller unit in a corrugated cardboard production device.

3. The roll-out apparatus according to claim 2, wherein:

said positioning means includes a hydraulic cylinder perpendicularly positioned in said corrugating roller unit; and a piston rod of said hydraulic cylinder connecting to said second movable support means, wherein activation of said hydraulic cylinder moves said second movable support means between a support position and a retracted position.

4. The roll-out apparatus according to claim 2, wherein:

said positioning means includes a motor; and raising/lowering means for transferring action of said motor into movement of said second movable support means, wherein activation of said motor moves said second movable support means between a support position and a retracted position.

5. The roll-out apparatus according to claim 2, wherein:

said first reference plane is located in a region below said corrugated cardboard production device; and said second reference plane is outside of said region below said corrugated cardboard production device.

6. The roll-out apparatus according to claim 2, wherein:

said first reference plane is located in a region below said corrugated cardboard production device; and a section of said first reference plane is cut away to form said second reference plane.

7. The roll-out apparatus according to claim 2, wherein:

said second reference plane is located in a region below said corrugated cardboard production device; and said first reference plane is outside of said region below said corrugated cardboard production device.

8. A roll-out apparatus, for rolling an object between a first reference plane and a second reference plane having an offset therebetween, comprising:

a first movable support means for supporting said object on one of said first reference plane and said second reference plane;

a second movable support means for supporting said object on the other of said first reference plane and said second reference plane;

said second movable support means includes a holder;

a first end of said holder pivotably attached to said object;

a second end of said holder having a wheel rotatably mounted thereon;

positioning means for locking said second support means when said object is supported thereon; and said positioning means permitting retraction of said second movable support means when said object is supported on said first movable support means, whereby said second movable support means is prevented from restricting movement of the object.

9. The roll-out apparatus according to claim 8, wherein said object is a corrugating roller unit in a corrugated cardboard production device.

10. The roll-out apparatus according to claim 9, wherein:

said positioning means includes a hydraulic cylinder perpendicularly positioned in said corrugating roller unit; and a piston rod of said hydraulic cylinder connecting, to said second movable support means, wherein activation of said hydraulic cylinder moves said second movable support means between a support position and a retracted position.

11. The roll-out apparatus according to claim 9, wherein:

said positioning means includes a motor; and raising/lowering means for transferring action of said motor into movement of said second movable support means, wherein activation of said motor moves said second movable support means between a support position and a retracted position.

12. The roll-out apparatus according to claim 9, wherein:

said first reference plane is located in a region below said corrugated cardboard production device; and said second reference plane is outside of said region below said corrugated cardboard production device.

13. The roll-out apparatus according to claim 9, wherein:

said first reference plane is located in a region below said corrugated cardboard production device; and a section of said first reference plane is cut away to form said second reference plane.

14. The roll-out apparatus according to claim 9, wherein:

said second reference plane is located in a region below said corrugated cardboard production device; and said first reference plane is outside of said region below said corrugated cardboard production device.

15. A roll-out apparatus, for rolling an object between a first reference plane and a second reference plane having an offset therebetween, comprising:

a first movable support means for supporting said object on one of said first reference plane and said second reference plane;

a second movable support means for supporting said object on the other of said first reference plane and said second reference plane;

a third movable support means for supporting an end of said object opposite said first movable support means when said object is supported by said first movable support means on said first reference plane;

said third movable support means supporting an end of said object opposite said second movable support means when said object is supported by said second movable support means on said second reference plane;

positioning means for locking said second support means when said object is supported thereon; and said positioning means permitting retraction of said second movable support means when said object is supported on said first movable support means, whereby said second movable support means is prevented from restricting movement of the object.

16. The roll-out apparatus according to claim 15, wherein said object is a corrugating roller unit in a corrugated cardboard production device.

17. The roll-out apparatus according to claim 16, wherein:

said positioning means includes a hydraulic cylinder perpendicularly positioned in said corrugating roller unit; and a piston rod of said hydraulic cylinder connecting to said second movable support means, wherein activation of said hydraulic cylinder moves said second movable support means between a support position and a retracted position.

18. The roll-out apparatus according to claim 16, wherein:

said positioning means includes a motor; and raising/lowering means for transferring action of said motor into movement of said second movable support means, wherein activation of said motor moves said second movable support means between a support position and a retracted position.

19. The roll-out apparatus according to claim 16, wherein:

said first reference plane is located in a region below said corrugated cardboard production device; and said second reference plane is outside of said region below said corrugated cardboard production device.

20. The roll-out apparatus according to claim 16, wherein:

said first reference plane is located in a region below said corrugated cardboard production device; and a section of said first reference plane is cut away to form said second reference plane.

* * * * *